US005199262A

United States Patent [19]

Bell

[11] Patent Number: 5,199,262

[45] Date of Patent: Apr. 6, 1993

[54] COMPOUND FOUR STROKE INTERNAL COMBUSTION ENGINE WITH CROSSOVER OVERCHARGING

[75] Inventor: James A. E. Bell, Oakville, Canada

[73] Assignee: Inco Limited, Toronto, Canada

[21] Appl. No.: 788,005

[22] Filed: Nov. 5, 1991

[51] Int. Cl.[5] ..... F02G 3/02

[52] U.S. Cl. ..... 60/622

[58] Field of Search ..... 60/620, 622; 123/560

[56] References Cited

U.S. PATENT DOCUMENTS

| | | | |
|---|---|---|---|
| 967,828 | 8/1910 | Pierson . | |
| 1,006,166 | 10/1911 | Wright | 60/622 |
| 1,562,692 | 11/1925 | Rochefort-Lucay . | |
| 1,576,357 | 3/1926 | Pierce . | |
| 1,636,937 | 7/1927 | Hult . | |
| 1,690,080 | 10/1928 | Seng et al. . | |
| 1,849,566 | 3/1932 | Brunnschweiler | 60/622 |
| 1,904,070 | 4/1933 | Morgan . | |
| 1,904,871 | 4/1933 | Lindberg | 60/620 |
| 3,267,661 | 8/1966 | Petrie . | |
| 4,159,700 | 7/1979 | McCrum | 123/59 EC |
| 4,186,561 | 2/1980 | Wishart | 60/620 |
| 4,599,863 | 7/1986 | Marttila | 60/616 |
| 4,986,234 | 1/1991 | Bell | 123/193 CP |

FOREIGN PATENT DOCUMENTS

| | | |
|---|---|---|
| 717771 | 2/1942 | Fed. Rep. of Germany . |
| 2402682 | 7/1974 | Fed. Rep. of Germany . |

OTHER PUBLICATIONS

"Comparative Evaluations of Three Alternate Power Cycles for Waste Heat Recovery From Exhaust of Adiabatic Diesel Engines," by M. M. Barley, Jul. 1985, DOE/NASA/50194-43 NASA TM-86953, pp. 1-23.

"An Assessment of the Performance and Requirements for 'Adiabatic' Engines," J. Zucchetto, P. Meyers, J. Johnson, D. Miller, Science, vol. 240, May 27, 1988.

*Primary Examiner*—Michael Koczo

*Attorney, Agent, or Firm*—Edward A. Steen

[57] ABSTRACT

A normally aspirated compounded, overcharged (supercharged) four stroke internal combustion engine, preferably diesel, which is particularly useful in adiabatic (low heat rejection) versions. An auxiliary expansion piston and compression piston reciprocate at least twice as fast as the combustion pistons to increase the volumetric efficiency of the engine as well as to overcharge the air charge within the combustion cylinders. Increased efficiency and simplified construction result.

10 Claims, 3 Drawing Sheets

COMPOUND FOUR STROKE INTERNAL COMBUSTION ENGINE WITH CROSSOVER OVERCHARGING

TECHNICAL FIELD

The instant invention is directed towards internal combustion engines in general and, more particularly, to a compounded overcharged engine that develops increased efficiency especially when used in its adiabatic diesel version.

BACKGROUND ART

Throughout their history, attempts have been made to increase the efficiency of internal combustion engines. Although many designs and alternatives have been proposed, it is generally conceded that for the foreseeable future, the spark ignition and diesel designs will be the motive engines of choice.

Mass produced engines have relatively mediocre efficiency ratings—about 35–40%. The great bulk of wasted energy is lost in the form of unutilized heat. Accordingly, engine development has been directed towards increasing the recovery and utilization of the lost heat.

In particular, in recent years there has been extensive research directed towards adiabatic engines (more properly low heat rejection engines) and methods of recovering extra power from them. These are best summarized in *Comparative Evaluations of Three Alternate Power Cycles for Waste Heat Recovery from Exhaust of Adiabatic Diesel Engines*, by M. M. Barley, Jul. 1985, DOE/NASA/50194-43 NASA TM-86953. This study compared the efficiencies of turbocharged, turbocharged-after cooled engines, turbocharged-turbocompounded and turbocharged-turbocompound-after cooled. It also compared the costs and efficiencies for three methods of auxiliary power derived from the waste heat, namely steam Rankine, organic Rankine and Brayton cycles. All of this recent work involves turbine auxiliaries, i.e. in a turbocharged-turbocompounded diesel engine, the diesel exhaust passes first through a hot turbine connected by a shaft to a turbocompressor and then the hot gas passes through another hot turbine connected through a gear train to the crankshaft. Analysis of this report shows that none of these alternatives are presently economical with respect to a standard diesel truck engine with turbocharging and aftercooling. That is to say that the fuel saving cannot pay for the increased capital cost of the compound engine designs. Likewise, older compound diesel engine designs employing compounding by auxiliary pistons have never proven economical. This is in the most part because designs proposed in the past have lost far more power per unit volume of cylinder than they gain in specific fuel consumption or again the fuel saving could never justify the increased capital cost.

Attention is also directed towards *A Review of the State of the Art and Projected Technology of Low Heat Rejection Engines*, 1987, National Research Council, National Academy Press, Washington, DC. This reference discusses various approaches towards boosting efficiency by achieving lower heat rejection rates.

Since the advent of the internal combustion engine many evolutionary changes in design have taken place to improve its performance and reliability. In the past twenty years the subject of adiabatic engines has received a great deal of attention. Initial prediction of gains to be achieved by adiabatic engines have not been borne out and in 1985 the National Research Council of the United States of America through its Energy Engineering Board started a review of the state of the art of low heat rejection internal combustion engines (*An Assessment of the Performance and Requirements for "Adiabatic" Engines*, J. Zucchetto, P. Meyers, J. Johnson, D. Miller, Science, Vol. 240, May 27, 1988). The conclusions were that for a cylinder with isothermal walls 4% and 8% improvements in fuel efficiency could be obtained. A good report on the economics of low heat rejection engines and methods of heat recovery from the exhaust gases is given by the DOE/NASA report referred to earlier.

SUMMARY OF THE INVENTION

This invention relates to a normally aspirated overcharged (supercharged) compounded engine, preferably diesel, which is particularly useful when the engine is also adiabatic. The objective of this invention is to improve the efficiency of an internal combustion engine from around 40% to around 60% without decreasing the volumetric power of the engine compared to the standard turbocharged (uncompounded) engine.

The invention includes a plurality of combustion cylinders and a common power crankshaft, an auxiliary expansion cylinder and an auxiliary compression cylinder similar in size to the combustion cylinders preferably mounted on a separate crankshaft operating at least two times the speed of the power crankshaft. The combustion cylinders and the auxiliary compression cylinder partially simultaneously aspirate air. The exhaust from the combustion cylinders and the auxiliary expansion cylinder is partially simultaneously exhausted. With an arrangement of four combustion cylinders operating on a four stroke cycle, and one expansion and one compression auxiliary cylinder operating on a two stroke cycle at two times the power crankshaft speed, the volumetric efficiency or power of the engine will be 4/6 of the power of a six cylinder turbocharged engine times the improvement in efficiency afforded by the extra expansion in the expansion cylinder of the gas from the combustion cylinders.

PREFERRED EMBODIMENT OF THE INVENTION

Figure 1:
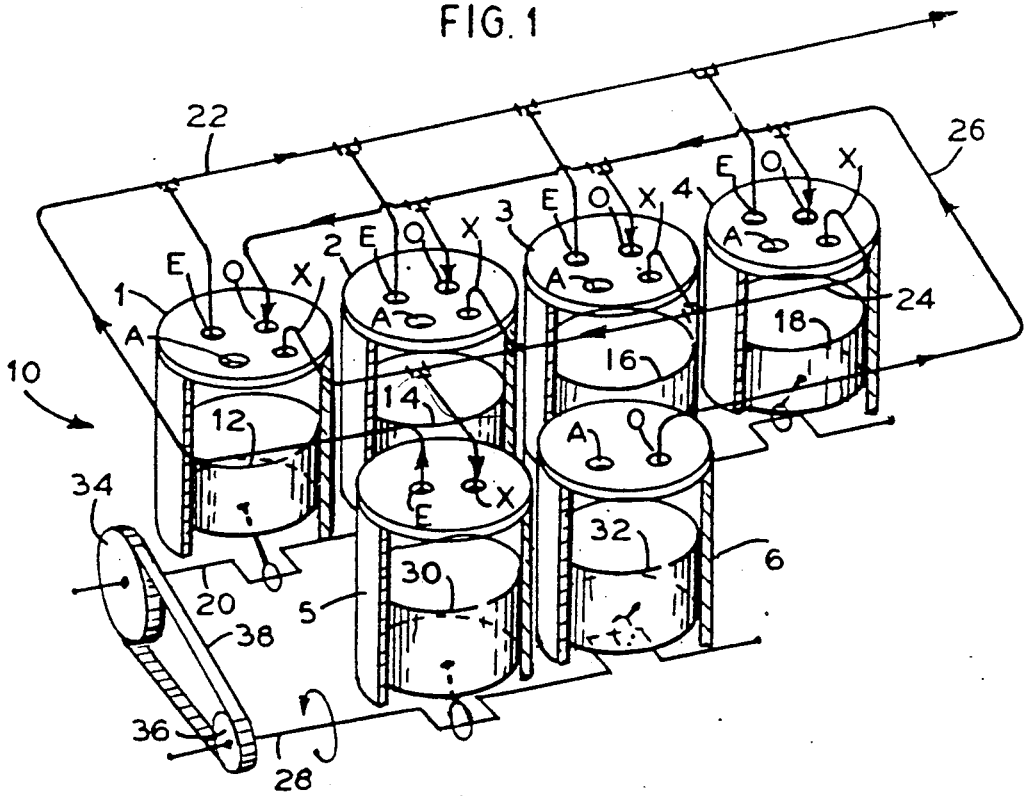
FIG. 1 is a schematic embodiment of the invention.

Referring to FIG. 1, there is shown a reciprocating engine 10. A number of known associated systems have been deleted for the purpose of clarity. The engine 10, although not limited to the embodiment shown, is comprised of a bank of combustion cylinders 1, 2, 3 and 4. Each combustion cylinder includes four overhead ports designated as A, E, X and O and associated pistons 12, 14, 16 and 18. These pistons are rotatably connected, in a known manner, to power crankshaft 20. Valves, not shown, open and close the ports A, E, X, O in a timed, regulated manner known to those in the art.

The E, for exhaust, ports communicate with exhaust manifold 22. The A, for aspirate, ports communicate with a source of air, not shown. The X, for crossover, ports communicate with crossover manifold 24. The O, for overcharge, ports communicate with compressor manifold 26.

Two auxiliary cylinders, expansion cylinder 5 with piston 30 and compression cylinder 6 with piston 32 are connected via auxiliary crankshaft 28. The auxiliary crankshaft 28 is configured to rotate at least twice as fast as the power crankshaft 20. This may be accomplished by a judicious choice of pulleys 34, 36 and belt 38 or by the appropriate gearing or other translational means (not shown).

The expansion cylinder 5 includes the two overhead ports E and X. The compression cylinder 6 includes the two overhead ports A and O. In each case, the ports also communicate with the appropriate common manifold.

The arrows indicate the flow of the various gaseous fluids in the manifolds.

Fuel is injected into the combustion cylinders 1–4 by means known to those in the art. Moreover, although a preferred embodiment is a diesel engine, it is possible, subject to the discussions below, to adopt the instant invention to operate as a spark ignition engine.

Figure 2:
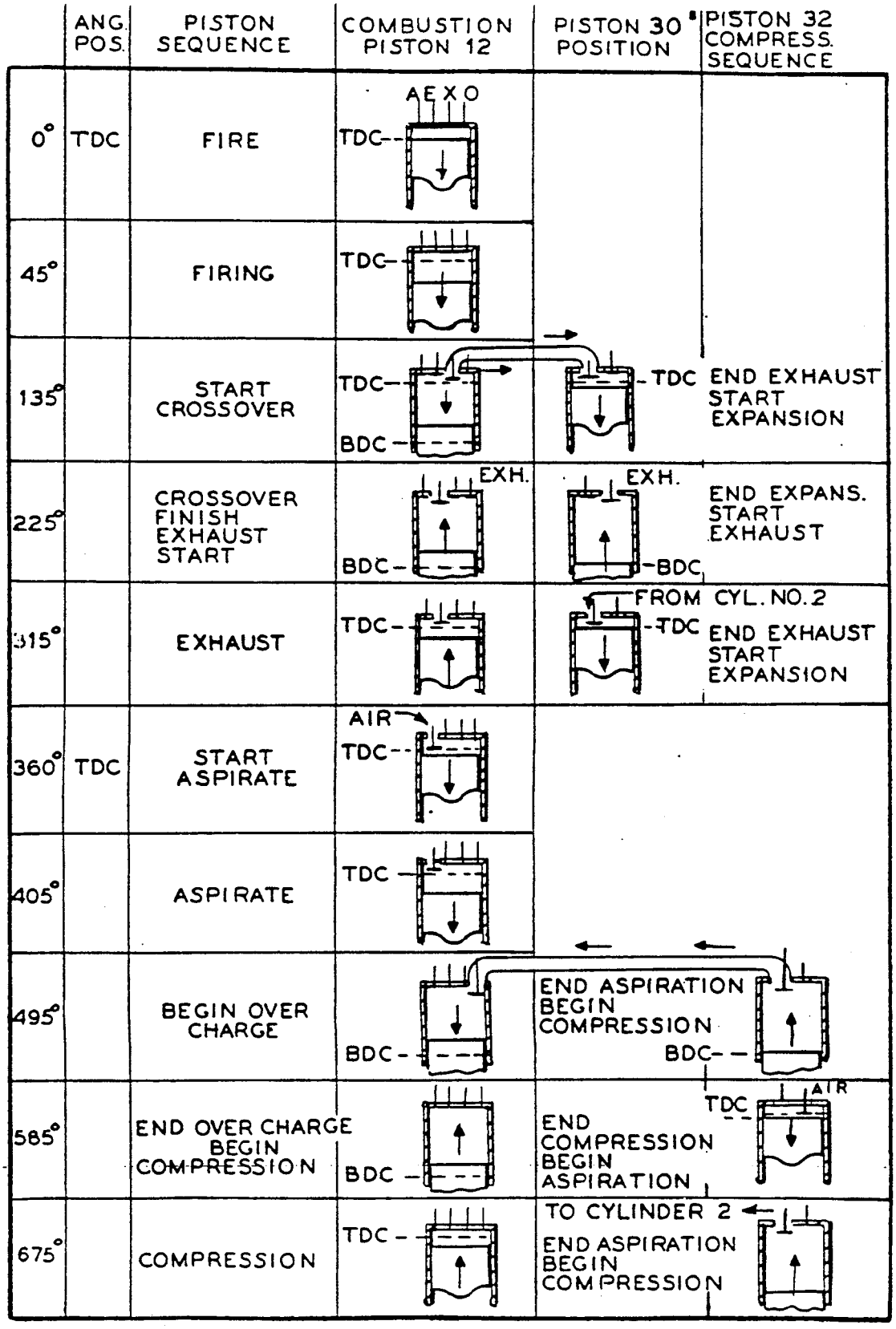
FIG. 2 is a simplified timing diagram of an embodiment of the invention.

The operation of the engine 10 is illustrated schematically in FIG. 2 which shows the position of the first combustion piston 12 and the auxiliary pistons 30 and 32 as a function of crank angle. Not all the combustion pistons are shown for ease of presentation. However, they all follow the same sequence and are 180° apart.

Table 1 shows the valve positions for all the cylinders as a function of crank angle.

TABLE 1

VALVE SEQUENCE

| Combustion Cylinders | | | | | | | | | | | | | | | | | | | | Auxiliary Cylinders | | | | | |
|---|---|---|---|---|---|---|---|---|---|---|---|---|---|---|---|---|---|---|---|---|---|---|---|---|---|
| #1 | | | | | #2 | | | | | #3 | | | | | #4 | | | | | Expansion #5 | | | Compression #6 | | |
| Deg. | A | E | X | O | Deg. | A | E | X | O | Deg. | A | E | X | O | Deg. | A | E | X | O | Deg. | X | E | Deg. | X | O |
| | | Fire | | | | | | | | | | | | | | | | | | | | | | | |
| 0 | - | - | - | - | | | | | | | | | | | | | | | | | | | | | |
| | | Expansion | | | | | | | | | | | | | | | | | | | | | | | |
| 45 | - | - | - | - | 585 | - | - | - | - | 405 | ^ | - | - | - | 225 | - | ^ | - | - | BDC | - | ^ | TDC | - | ^ |
| | | X-Over | | | | | | | | | | | | | | | | | | | | | | | |
| 135 | - | - | ^ | - | 675 | - | - | - | - | 495 | - | - | - | ^ | 315 | - | ^ | - | - | TDC | ^[1] | - | BDC | ^[3] | - |
| | | | | | | | Fire | | | | | | | | | | | | | | | | | | |
| 180 | | | | | 0 | - | - | - | - | | | | | | 360 | ^ | - | - | - | | | | | | |
| | | Exhaust | | | | | | | | | | | | | | | | | | | | | | | |
| 225 | - | ^ | - | - | 45 | - | - | - | - | 585 | - | - | - | - | 405 | ^ | - | - | - | BDC | - | ^ | TDC | - | ^ |
| | | Exhaust | | | | | | | | | | | | | | | | | | | | | | | |
| 315 | - | ^ | - | - | 135 | - | - | ^ | - | 675 | - | - | - | - | 495 | - | - | - | ^ | TDC | ^[2] | - | BDC | ^[4] | - |
| | | | | | | | | | | | | Fire | | | | | | | | | | | | | |
| 360 | ^ | - | - | - | | | | | | 0 | - | - | - | - | | | | | | | | | | | |
| | | Aspirate | | | | | | | | | | | | | | | | | | | | | | | |
| 405 | ^ | - | - | - | 225 | - | ^ | - | - | 45 | - | - | - | - | 585 | - | - | - | - | BDC | - | ^ | TDC | - | ^ |
| | | Overcharge | | | | | | | | | | | | | | | | | | | | | | | |
| 495 | - | - | - | - | 315 | - | ^ | - | - | 135 | - | - | ^ | - | 675 | - | - | - | - | TDC | ^[3] | - | BDC | ^[1] | - |
| | | | | | | | | | | | | | | | | | | Fire | | | | | | | |
| | | | | | 360 | ^ | - | - | - | | | | | | 0 | - | - | - | - | | | | | | |
| | | Compression | | | | | | | | | | | | | | | | | | | | | | | |
| 585 | - | - | - | - | 405 | ^ | - | - | - | 225 | - | ^ | - | - | 45 | - | - | - | - | BDC | - | ^ | TDC | - | ^ |
| | | Compression | | | | | | | | | | | | | | | | | | | | | | | |
| 675 | - | - | - | - | 495 | - | - | - | ^ | 315 | - | ^ | - | - | 135 | - | - | ^ | - | TDC | ^[4] | - | BDC | ^[2] | - |
| 720 | - | - | - | - | | | | | | 360 | ^ | - | - | - | | | | | | | | | | | |

Legend:
Deg. - Crank Angle Degree
E - Exhaust
X - X-Over
A - Aspirate
- - Valve Closed
^ - Valve Open
O - Over Charge
TDC - Top Dead Center
BDC - Bottom Dead Center The operation of the engine 10 is easily understood from FIG. 2 and Table 1. For instance, combustion cylinder 1 fires at 0° crank angle or plus or minus a few degrees depending on the fuel and type of engine (diesel or gas). At 45° the piston 12 is $\frac{1}{4}$ the way down the cylinder 1 and the combusted gases are expanding and exerting forces on the piston 12. All the valves remain closed. At 135° the combustion piston 12 is $\frac{3}{4}$ of the way down the cylinder 1 time-wise. At this point the crossover valve X opens on both the combustion cylinder 1 and the expansion cylinder 5. The piston 30 in the expansion cylinder 5 is at top dead center (TDC) and moving at twice the speed of the combustion piston 1. Thus, when the combustion piston 1 moved from crank angle 135° to crank angle 225° or by 90° (225°−135°) the auxiliary piston 30 has moved $90\times2=180°$ and is now at bottom dead center (BDC).

If the combustion cylinder 1 had not been connected to the expansion cylinder 5, as in a conventional engine, its expansion would have been one cylinder volume. With the expansion cylinder 5 being approximately the same size as the combustion cylinders the expanded volume is now 1.86 cylinder volumes. The large effect that this extra expansion has on the thermal efficiency of the engine 10 will be discussed below.

At this time, the crank angle is 225° on the combustion cylinder 1 and BDC on the expansion cylinder 5, and the exhaust valves E on both the combustion cylinder 1 and the expansion cylinder 5 open. At 315° the piston 12 is still approaching TDC and its exhaust valve E is still open while the expansion cylinder 5 has reached TDC, its exhaust valve E closes and its cross-over valve X opens to receive combusted gases from combustion cylinder 2. At 360° the power cylinder 1 has completed one revolution, its exhaust valve E closes and the aspirator valve A opens. The combustion cylinder 1 continues to aspirate atmospheric pressure air until crank angle 495°. At this point the piston 12 is ¾ of the way to BDC time-wise or 86% of the way to BDC volume-wise. At this point the aspirator valve A closes and the overcharge valve O opens on both the combustion cylinder 1 and the compression cylinder 6. The piston 12 in the compression cylinder 1 moves through BDC and by the time the piston 12 in the combustion cylinder 1 has moved from crank angle 495° to 585° (or 585°−495°=90°) the piston 32 in the compression cylinder 6 has moved from BDC to TDC or 180° because it is moving at twice the rotational speed on the combustion cylinder 1. Thus, by the time 585° crank angle has been reached the piston in the combustion cylinder 1 is 45° after BDC and is at a pressure of 1.86 atmospheres. In contrast, if the combustion cylinder 1 was operating in a conventional aspirated engine then the pressure would be 1.14 atmosphere. At this point the overcharge valve O closes on both the compression cylinder 6 and the combustion cylinder 1. All of the valves on the combustion cylinder 1 remain closed until 720° is reached at which time fuel is injected and the firing cycle begins again.

The complete valve timing diagram is shown in Table 1 for all of the cylinders. From this arrangement of components, Table 1 shows that all of the cylinders are overcharged and double expanded. This desired result also follows if one considers the four combustion cylinders on a four stroke cycle have four firings, four expansions, four compressions and four aspirations while the expansion cylinder 5, operating at twice the rotation speed on a two stroke cycle, has 1×2×2=4 expansions and four exhausts and the single compression cylinder 6 on a two stroke cycle has 1×2×2=4 compressions and four aspirations.

In practice, the combustion cylinder firing sequence would be sequentially staggered to balance the crankshaft. The sequence shown in Table 1 is merely the simplest to comprehend.

If the expansion cylinder 5 and the compression cylinder 6 were made fourteen percent larger, the new engine of type described herein is equivalent to a turbocharged-turbocompounded engine with a turbocharging ratio of two. However, it should be borne in mind that complex engineering problems associated with turbochargers have been eliminated.

Essentially a portion of the waste energy normally allowed to flow out the tailpipe is recovered towards the end of the power stroke and routed into the expansion cylinder 5 where it works against the expansion piston 30 by increasing the total volumetric efficiency of the engine. This increased work essentially "pays the freight" (and more) in driving the compression cylinder 6 to overcharge (or supercharge) the combustion cylinder. This finite increase in net work translates into higher efficiencies and lower fuel consumption.

One expansion cylinder having a total volume area equal to each power cylinder effectively doubles the total volume of the engine thusly increasing the volumetric efficiency of the engine.

The invention and the manner of applying it may be better understood by a brief discussion of the principles underlying the invention.

A major object of the invention is to generate higher temperatures within the cylinders. Although it is possible to utilize the instant invention with spark-ignition engines, cooling would be required. Otherwise the air during the compression stroke will be above the self-ignition temperature, essentially defeating a major advantage of the engine. Accordingly, it is preferred to employ diesel engines.

For adiabatic compression during the compression stroke, the temperature rises and is given by:

$$T_2 = T_1\left(\frac{V_1}{V_2}\right)^{n-1} \quad \text{where } n = \frac{C_p}{C_v} \approx 1.35 \text{ for air}$$

where $T_1$ and $V_1$ are the initial temperature in absolute units and maximum volume of the cylinder and $T_2$ is the temperature after compression and $V_2$ the volume after compression. $C_p$ is the specific heat at constant pressure whereas $C_v$ is the specific heat at constant volume.

The corresponding pressures are:

$$\frac{P_2}{P_1} = \left(\frac{V_1}{V_2}\right)^{n} \quad \text{where } n \approx 1.35$$

The fuel is then injected into the cylinder. The percent aeration is usually set so at the maximum work output or fuel injection rate that 200% of the theoretical air required to completely oxidize the fuel is maintained. No. 2 fuel having an API of 36 is a commonly used diesel fuel. It has a low heat value of 18410 BTU/lb ($4.28\times10^7$ J/Kg) and requires 14.86 lbs (6.68 Kg) of air as a theoretical oxidizer. At 218% aeration the temperature of the gases after combustion will rise 2101° F. (1149° C.)=ΔT combustion.

The fuel in the "diesel" cycle is injected so that constant pressure is approximately maintained in the cylinder as the cylinder begins its power stroke. The volume after combustion has terminated is expressed by:

$$\frac{V \text{ after combustion}}{V \text{ after compression}} = \frac{T \text{ after compression} + \Delta T \text{ combustion}}{T \text{ after compression}}$$

In the Otto cycle the combustion is instantaneous and the pressure is allowed to rise. The Otto cycle gives a much higher theoretical efficiency. However, the pressure rise is too fast and leads to engine damage. In practice a cycle between the Otto and diesel cycle is used. In large diesel engines the pressure is allowed to rise as fast as commensurate without producing knock to achieve the highest efficiency. The pressure rise is usually held to around 1.3, i.e.

$$\frac{P_1}{P_2} = \frac{1}{1.3}$$

$$\frac{V \text{ after combustion}}{V \text{ after compression}} = \frac{(P_1)}{(P_2)} \quad \frac{(T \text{ after compression} + \Delta T \text{ combustion})}{T \text{ after compression}}$$

As the power stroke continues the gases will cool by adiabatic expansion. At the end of the power stroke:

cal calculations give the same answer as the actual engines.

TABLE 2

EFFICIENCY OF 4 STROKE DIESEL ENGINE
218% AERATION, 14.5% COMPRESSION RATIO
MIXED OTTO & DIESEL CYCLE WITH PRESSURE RISE OF 1.30

| | % Heat to | | | | | |
|---|---|---|---|---|---|---|
| Description | Intercooling | Cooling | Exhaust Enthalpy | Exhaust Pressure | Eff. % | Relative Power |
| Normally Aspirated Water Cooled | 0 | 14 | 29.9 | 17.3 | 38.8 | 49 |
| Normally Aspirated Adiabatic | 0 | 0 | 35 | 21 | 44 | 56 |
| Turbocharged (2.0) Intercooled, Water Cooled | 5 | 14 | | | 39.4 | 100 |
| Turbocharged Intercooled Adiabatic | 5 | 0 | | | 44.2 | 112 |
| Turbocharged and Compounded (2.0) Intercooled, Water Cooled | 5 | 14 | | | 46.5 | 118 |
| Turbocharged and Compounded, Intercooled Adiabatic | 5 | 0 | | | 55.3 | 140 |
| Crossover Adiabatic | 0 | 0 | 27 | 15 | 58 | 98 |
| Crossover Water Cooled | 0 | 14 | 23 | 12.3 | 50.6 | 85 |

$$T\text{ after expansion} = T\text{ after combustion}\left(\frac{V\text{ after combustion}}{V\text{ of cylinder}}\right)^{n-1}$$

and the pressure will be:

$$P\text{ after expansion} = P\text{ after combustion}\left(\frac{V\text{ after combustion}}{V\text{ of cylinder}}\right)^{n}$$

At this point the exhaust valve will open and this pressure will cause the gas to further expand and lose temperature so:

$$T\text{ exhaust} = T\text{ after expansion}\left(\frac{P\text{ atm}}{P\text{ after expansion}}\right)^{\frac{n-1}{n}}$$

Since no heat losses were taken from the walls, the above calculation gives temperatures and pressures of an adiabatic diesel cylinder.

In conventional water cooled small block engines the heat loss amounts to some 25% of the heat input while in larger engines the heat loss amounts to 14%. However, if the engine has an aftercooled turbocharger an additional 7 to 12% heat loss occurs depending on the degree of turbocharging.

Most of the block heat loss occurs at the highest temperatures during combustion. Thus the simplest assumption to make to do the calculations for an actual large engine is to subtract 14% of the heat input during the combustion cycle. Thus the $\Delta T$ rise in temperature would be $0.86\times2101°$ F. (1149° C.)=1806° F. (986° C.) at 218% aeration.

Table 2 shows the efficiencies of adiabatic and conventionally cooled large diesel engines at 218% aeration (full power) with and without turbocharging and with and without turbocompounding. A pressure rise of 1.3 in a mixed Otto and diesel cycle is used. The same data is shown graphically in FIG. 3. Note that the theoretical calculations give the same answer as the actual engines.

As shown in Table 2 designing an engine with no cooling (adiabatic) by itself will only increase the thermal efficiency of the engine by 5% at full power. The Energy Engineering Board of the National Research Council USA confirms this finding. From Table 2 when the cylinder is insulated and the cooling loss avoided, increased heat is transferred to the exhaust gas as both increased sensible heat and pressure.

When an engine is turbocharged the power rating of the engine increases because more air is flowing through the engine but the thermal efficiency is increased by an insignificant amount.

Turbocharged and turbocompounded engines have been built in the past. The drawback of the turbocompound engine is if the power turbine is kept to reasonable size the rotation speed must be over 30,000 rpm and it has to be reduced and coupled to the drive train running at around 1500 rpm. Another problem with this solution is that carbon or soot buildup occurs on the power turbine and eventually ignites and burns out the turbine. An additional problem is the low efficiency of the turbocharger and compounder. These designs raise the efficiency of an adiabatic engine to somewhere around 58% depending on the power turbine efficiency. With normal cooling the efficiency of turbocompounded engines is around 47%.

The instant concept of crossover can also be used on a conventional water cooled engine. For a large engine with 13% heat loss the efficiency would be 51%. Thus, as the crossover engine is made adiabatic the efficiency rises from 51 to 58% while the conventional turbocharged engine increases from 39 to 44% as it becomes more adiabatic.

Figure 3:
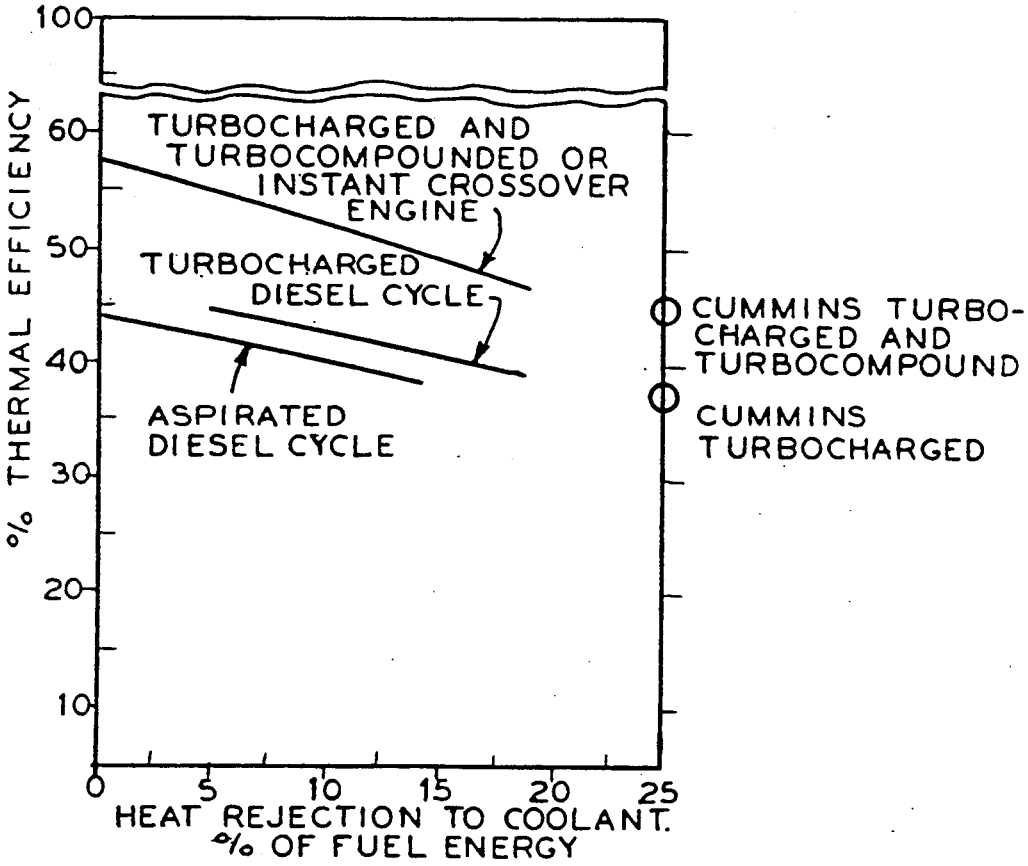
FIG. 3 is a thermal efficiency diagram of various diesel engines having mixed cycles and a pressure rise of 1.3.

As shown in FIG. 3 the thermal efficiency of the turbocharged and turbocompound engine is about the same as the instant overcharged crossover engine. They are expected to have the same efficiency because the instant overcharged crossover engine recovers about ½ of the pressure energy and overcharges the engine by a factor of 2 while the turbo-turbine, the air compressor turbine and the power turbine all run under 80% efficiency or at $0.8\times0.8\times0.9=0.51$ overall efficiency.

Thus, the instant overcharged crossover engine is the piston equivalent of the turbocharged and turbocompounded engine. The instant overcharged crossover engine will always be more economical to produce and operate (at least in the size used in vehicles) than the turbocharged and turbocompounded engines for all the same reasons that diesels are cheaper and more economical to operate than turbines. Cummins' experimental designs are also shown on FIG. 3.

Figure 4:
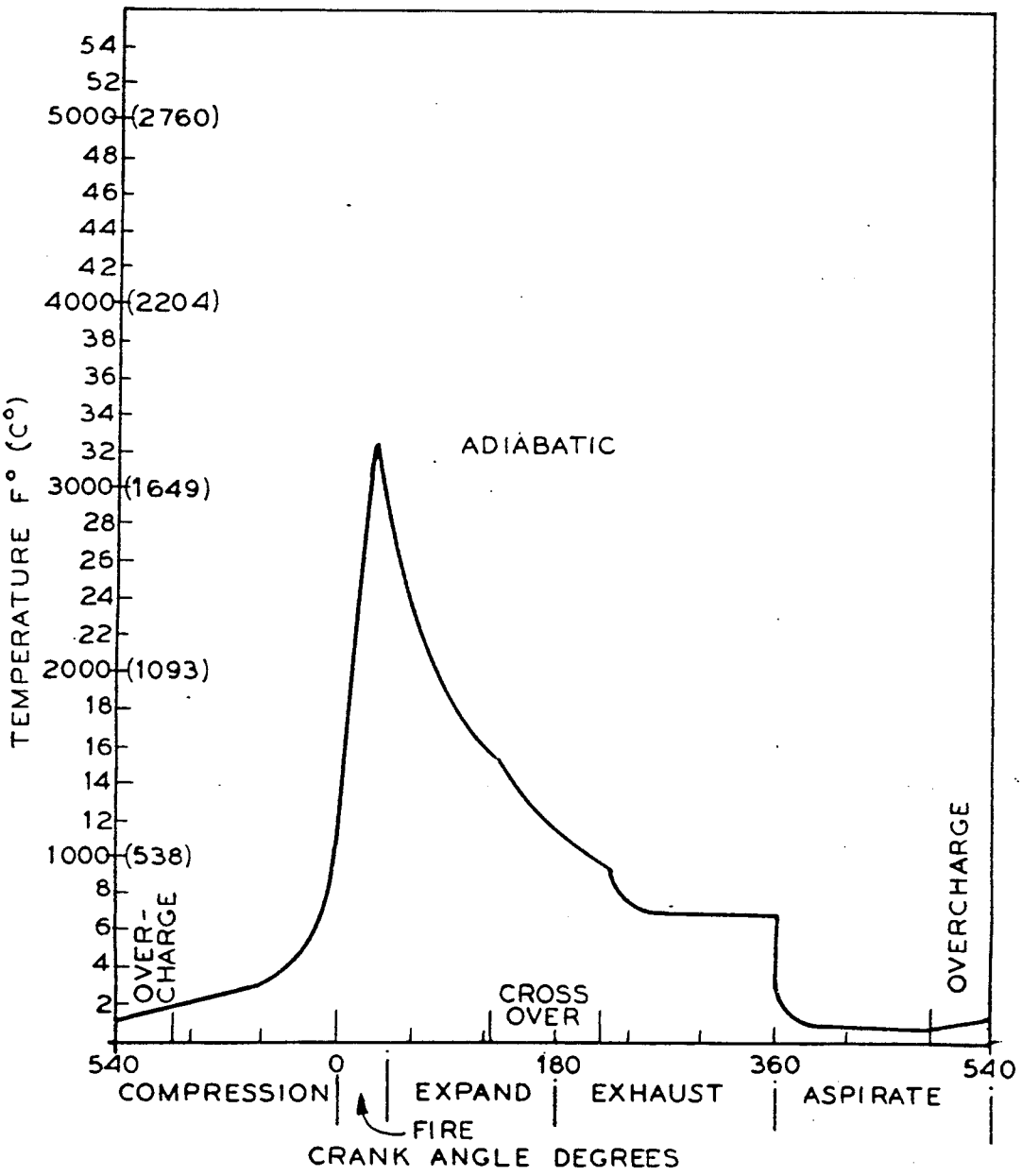
FIG. 4 is a calculated temperature diagram for large diesel engines employing the instant overcharging and crossover techniques with mixed cycles and a pressure rise of 1.3.

The most advantageous configuration of the invention is the fully adiabatic version. The temperatures involved in the engine as shown in FIG. 4 are not severe. In fact the simplest adiabatic engine could have the head, piston crown, valves and cylinder liner of the combustion cylinders made from conventional superalloys (i.e. INCOLOY® alloy 718) with the judicious use of controlled expansion superalloys (i.e. INCOLOY® alloy 909) to give a uniform expansion to the engine. With these materials the engine could be fully insulated. Note that the energy robbing coolant water pump, thermostat, fan and radiator would no longer be required.

The thermal efficiency of the instant overcharged crossover engine is 50.6% compared to 39.4% for a turbocharged after cooled diesel engine while the power is $\frac{2}{3}\times 50.6/39.4=85\%$ of the turbocharged after cooled engine.

The instant engine, if adiabatic, has a thermal efficiency of 57.7% and a power ratio of 98% of the standard turbocharged aftercooled engine. In other words in its most advantageous configuration the new crossover has the same power and the fuel consumption of only 68% of a conventional turbocharged engine. If compared to a standard gasoline engine the improvement in fuel conservation is even greater.

Although four combustion cylinders are depicted in FIG. 1, additional combustion cylinders and auxiliary cylinders may be employed. For example, if six power cylinders are utilized, the two auxiliary cylinders may still be used, but running at least three times the speed of the power crankshaft. If eight combustion cylinders are utilized, the two auxiliary cylinders are turned at least four times as fast. In fact, various multiples of combustion cylinders and auxiliary cylinders may be used.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A reciprocating piston four stroke internal combustion engine, the engine comprising a plurality of associated combustion pistons and cylinders, the combustion pistons rotatably connected to a power crankshaft, means for introducing fuel into the combustion cylinders, at least one expansion piston and cylinder, at least one compression piston and cylinder, the expansion piston and the compression piston rotatably connected to an auxiliary crankshaft, means for reciprocating the expansion piston and the compression piston at least twice as fast as the combustion pistons, means for introducing air into the combustion cylinders and the compression cylinder, means for exhausting the combustion cylinders and the expansion cylinder, crossover means for flowably connecting the combustion cylinders to the expansion cylinder, and overcharging means for flowably connecting the compression cylinder to the combustion cylinders.

2. The engine according to claim 1 wherein the combustion cylinders include an overhead exhaust port, crossover port, overcharge port, aspiration port, the expansion cylinder includes an overhead exhaust port and crossover port, the compression cylinder includes an overhead aspiration port and overcharge port, and means for opening and closing all of the ports.

3. The engine according to claim 2 wherein the crossover ports of the combustion cylinders and the crossover port of the expansion cylinder communicate, the overcharge ports of the combustion cylinders and the overcharge port of the expansion cylinder communicate, and timing means for causing all of the ports to open and close in a predetermined pattern.

4. The engine according to claim 3 wherein the ports of a combustion cylinder, the expansion cylinder, and the expansion cylinder sequentially open and close as shown in FIG. 2.

5. The engine according to claim 3 including four combustion cylinders, one expansion cylinder, and one compression cylinder, and shown in Table 1.

6. The engine according to claim 3 wherein an expansion cylinder and a combustion cylinder at least partially simultaneously exhaust.

7. The engine according to claim 3 wherein a compression cylinder and a combustion cylinder at least partially simultaneously aspirate air.

8. The engine according to claim 1 including electrical means for igniting the fuel in the combustion cylinders.

9. The engine according to claim 1 wherein the pistons of the combustion cylinders, the expansion cylinder and the overcharge cylinder are the same size.

10. The engine according to claim 1 including means for cooling the engine.

* * * * *